United States Patent [19]

Sudrabin

[11] Patent Number: 4,554,124

[45] Date of Patent: Nov. 19, 1985

[54] HORIZONTALLY POURED FIBRESTONE BUILDING CONSTRUCTION

[75] Inventor: David A. Sudrabin, Delray Beach, Fla.

[73] Assignee: Fibrestone Incorporated, LaBelle, Fla.

[21] Appl. No.: 506,526

[22] Filed: Jun. 22, 1983

Related U.S. Application Data

[63] Continuation-in-part of Ser. No. 472,657, Mar. 7, 1983, abandoned.

[51] Int. Cl.[4] ..... E04B 5/04

[52] U.S. Cl. ..... 264/263; 264/261; 264/35; 52/601; 52/612

[58] Field of Search ..... 52/601, 745, 309.17, 52/309.12; 264/263, 45.3, 35

[56] References Cited

U.S. PATENT DOCUMENTS

| | | | |
|---|---|---|---|
| 1,394,550 | 10/1921 | Herbrick | 52/601 |
| 2,007,148 | 7/1935 | White | 52/612 |
| 2,222,037 | 11/1940 | Lafferty | 52/601 |
| 2,305,684 | 12/1942 | Foster | 52/405 |
| 2,703,004 | 3/1955 | Kenedy | 52/601 |
| 2,934,934 | 5/1960 | Berliner | 52/601 |
| 3,258,889 | 7/1966 | Baycher | 264/263 |
| 3,435,580 | 4/1969 | Merrill | 52/405 |
| 3,868,296 | 2/1975 | McKeon | 52/612 |
| 3,885,008 | 5/1975 | Martin | 264/263 |
| 4,364,987 | 12/1982 | Goodwin | 52/601 |
| 4,785,437 | 1/1980 | Robinson | 52/601 |

FOREIGN PATENT DOCUMENTS

| | | | |
|---|---|---|---|
| 22107 | 1/1981 | European Pat. Off. | 52/405 |
| 2400928 | 7/1975 | Fed. Rep. of Germany | 52/601 |
| 2364571 | 9/1975 | Fed. Rep. of Germany | 52/309.12 |
| 1027354 | 5/1953 | France | 52/601 |
| 1171513 | 1/1959 | France | 52/601 |
| 1315946 | 12/1962 | France | 52/601 |
| 606868 | 6/1960 | Italy | 52/601 |

*Primary Examiner*—Henry E. Raduazo
*Attorney, Agent, or Firm*—Alfred E. Wilson

[57] ABSTRACT

In the Fibrestone Building Construction the outer or exterior shell or panel is formed of a plastic material such as concrete reinforced by a high concentration of fibers, such as glass or other fibrous material randomly disbursed in the mass of the moldable material such as concrete. If desired the fibers can be chopped up to accelerate their bonding in the mass of the moldable material. This moldable material and the fibrous reinforcement may be sprayed under pressure into a mold having a surface which it is desired to reproduce. The surface of the mold is reproduced faithfully, and a relatively thin but strong outer shell embodying the desired contour is thus formed. This outer shell or wall is assembled in a horizontal position, with its outer face down, with a frame of substantially uniform thickness throughout. All necessary insulation, wall reinforcements, appliance fittings, door and window cutouts and spaces for wall connectors and utility outlets are installed within the thickness of the framework. Concrete or other moldable material is then cast into the horizontally disposed framework to completely fill the space within the outer shell and the framework. After the cast material has attained an initial set the excess material is stricken off flush with the top of the framework to provide, when cured, a panel of uniform thickness and a smooth exterior surface. The fiber reinforced concrete which forms the desired exterior shell or wall is thus securely bonded to the cast concrete backing material to provide the Fibrestone wall which is a combination of the exterior fiber reinforced shell and the cast load bearing backing material.

4 Claims, 1 Drawing Figure

HORIZONTALLY POURED FIBRESTONE BUILDING CONSTRUCTION

CROSS REFERENCE TO RELATED INVENTIONS

This application is a continuation in part of our earlier filed application, W-2548, Serial No. 472,657 filed Mar. 7, 1983 and now abandoned.

BACKGROUND OF THE INVENTION

My previously filed application discloses a Fibrestone construction wherein the outer wall is mounted vertically on a foundation, and an inner wall which if desired may be an inside wall of the building, is spaced from the outer wall to provide a space between the walls into which concrete or other moldable material can be cast to provide a load bearing wall. Suitable spacers or studs interconnect the walls to hold the walls in proper spaced relation while the moldable material is introduced into the space between the walls to strengthen the walls and to form a load bearing structure capable of withstanding heavy loads.

SUMMARY OF THE INVENTION

The Fibrestone reinforced outer wall is formed by spraying into a mold having as a mold surface a replica of a wall surface to be reproduced, a mixture of cement, sand and water and a spray of fibrous material such as glass fibers are introduced into the mold to provide a mass of fibrous material saturated with the cement mixture. The fibers are very flexible when saturated and mixed with cement and it is possible to pick up very small details of the contouring of the mold such for example as wood graining. These fiber reinforced panels have excellent properties, and withstand the elements to good advantage when exposed as exterior walls. The Fibrestone wall utilizes the good features of the glass or other fiber reinforced panel to provide the desired detail, and to withstand the exposure to the outside environment, and combines therewith the excellent load bearing qualities of concrete to provide a wall having the desired qualities.

I have found that the outer and inner walls which cooperate to form the Fibrestone walls can be more readily and more economically formed by positioning the fiber reinforced outer wall horizontally with the exterior surface face down, and securing a framework to the back of the outer wall. All of the necessary components of the building wall are positioned within the framework, and the load carrying wall is secured to the outer wall by pouring concrete or other moldable material into the horizontally disposed framework and the back of the outer wall to tie all of the components together. The excess of the moldable material may be struck off flush with the top surface of the framework to provide a wall having a smooth outer surface and being of uniform thickness. By proceeding in this manner the Fibrestone wall is poured flat where virtually no hydrostatic pressure is encountered. Any desired additional braces may be positioned in the framework.

DESCRIPTION OF THE PREFERRED EMBODIMENT

Figure 1:
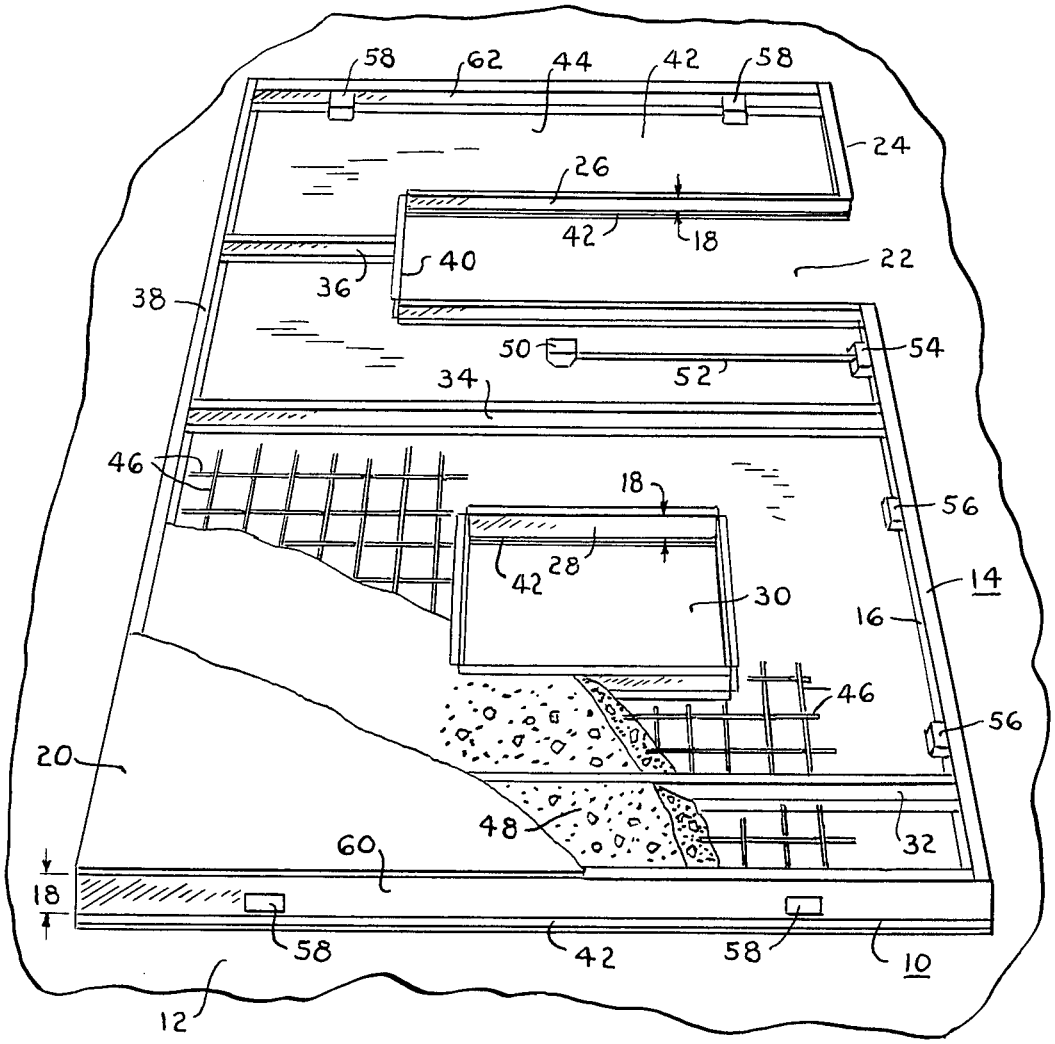
FIG. 1 is a perspective view illustrating the formation of a wall pursuant to this invention.

Referring now to the drawing the numeral 10 represents a Fibrestone wall, including an outer panel 10 formed as herein stated by spraying into a mold wherein for example fiber thread, yarn or roving such as glass fiber is chopped up into short lengths of approximately 1" to 2" and are injected with a molten substance such as concrete into a mold to form a thin panel conforming with the shape and surface detail of the mold, and from which, after curing, the panel is removed from the mold, and used as the exterior wall of a building structure.

The outer panel thus formed can embody any desired contour from which a mold can be formed. The panel 10 which may be of any desired thickness ranging approximately from $\frac{1}{4}$" to $\frac{3}{4}$" for example is placed face down on any smooth flat surface such as a foundation 12. This panel 10 forms the outside wall of the building structure which it is desired to construct. The Fibrestone wall is provided when a framework 14 preferably of C or channel shaped contour 16, and having a thickness 18 corresponding with the desired thickness of the wall to be formed, less the thickness of the Fibrestone outer panel 10, and the thickness of any interior panel 20 which may be employed to form the interior wall of the building structure being constructed is mounted on the inside surface of the Fibrestone panel 10. The framework 14 may be clamped or otherwise secured to the panel 10 in any convenient manner. The juncture between the framework 14 and the panel 10 may be sealed all the way around its edges in any convenient manner to prevent the escape of concrete or other material as hereinafter described.

The panel 10 may be contoured to provide any desired openings in the panel 10, such for example as with a cut-out section 22 to provide a doorway opening in the panel 10 which forms the outer wall of the building structure when the panel is elevated to the vertical position on the foundation 12 with the bottom side 24 of the wall in contact with the foundation 12 to provide a doorway into the building structure. A framework 26 of a C or channel shaped frame corresponding in thickness with the height 18 of the framework 14 surrounds the doorway cutout section 22, and is connected to the Fibrestone panel 10 in the same general manner as is the framework 14.

Another framework 28 of similar shape and thickness of height 18 as the frameworks 14 and 26 may be provided to frame a window opening 30 in the Fibrestone wall. Any other desired windows, doorways or other openings in the Fibrestone walls which form the walls of the building structure may be provided by cutting out appropriately shaped openings in the panels 10 which form the areas where the apertures are desired and positioning appropriate framework elements thereon.

Any suitably positioned braces or studs 32 and 34 may extend from the bottom side 24 of the framework 14 to the opposite side or top 38 of the framework 14 to provide a desired degree of stiffness or strength to the construction. Also a brace or stud 36 connected to the top 38 of the framework 14 and extending to the top 40 of the door frames 26 may be provided to add strength to the construction, and to provide load carrying members.

Any necessary fittings or fixtures which it is desired to suspend in the Fibrestone wall being formed, such for example as the electrical switch box 50 carried by a support 52 mounted in a blanked out housing 54 in the space between the back 44 of the panel 10 and the inner surface or top 38 of the frame 14. If water, gas or other dispensing valves or appliances are desired in the finished inside walls, the necessary receptacles may be positioned in the wall at the desired locations, and their supply lines or pipes can be installed in the space above the back surface 44 of the panel 10 and the top inner surface 38 of the frame 14 as shown at 56. Additional block out housing spaces 58 in the end walls 60 and 62 of the Fibrestone wall may be employed to block out the concrete to provide space for the reception of suitable connectors to secure adjacent Fibrestone walls together. When the connectors have been installed the space within the block out housing and the connectors may be filled with patching or other concrete or other suitable material to securely clamp the connectors in place.

If desired sheet insulation 42 may be positioned in contact with the back surface 44 of the panel 10 to position the insulation as close as possible to the outer wall to impede the flow of heat or cold through the panel 10.

Suitable reinforcement such for example as the wire mesh 46 may be suitably suspended in the space above the back surface 44 of the panel 10 and the space beneath the top 38 of the frames 14, 26 and 28 to reinforce concrete 48 to be introduced into the space above the back surface 44 of the Fibrestone panel 10 and the space within the frame 14 beneath the top 38 of the frame 14.

When all is in readiness, concrete, preferably having a high slump factor, is introduced into the space within the frame 14 and the outside of the confines of the door and window frames 26 and 28 to completely fill the space above the back surface 44 of the panel 10 and beneath the top 38 of the frames 14, 26 and 28. When the concrete has completely filled this space, a straightedge, such as a straight 2"×4" stud may be laid on the top of the frames and is pulled across the frames to strike off any excess concrete and to provide a straight flat surface on the back of the assembly.

If desired the surface of the concrete can be used as the inside wall of the building structure, plaster and paint being applied to it if desired. Also if preferred a sheet of "drywall" or gypsum 20 or plywood can be secured to the concrete surface and it can be treated with any desired decoration, such as paint or wallpaper or the finish of the plywood can be left exposed.

The Fibrestone wall thus formed can, when the concrete has completely set, be lifted by elevating the top side 38 of the framework 14 to stand the wall in a vertical position on the bottom side 24 of the foundation 12 or the assembly can be moved to any location where it is to be used. Any convenient brackets or fittings can be employed to secure the finished Fibrestone wall to the foundation 12, and to secure the wall to the other wall members positioned in line with or at any desired angle to the subject wall.

It will of course be understood that if the subject wall is installed in a multi-story building the thickness 18 of the framework 14 can be increased in the lower floor areas to provide greater strength and the thickness of the walls can be reduced as the loading on the walls decreases as higher levels are attained. Also it will be understood that concrete having a more concentrated mix of cement for use in specialized areas may be employed to provide columns or areas of greater strength to support the load to which the wall is subjected. Also it will be understood that any desired additives may be added to the concrete mix to provide desired strength, workability and physical properties.

Attention is directed to the fact that the concrete 48 or other suitable material secured to the panel 10 may be fastened thereto in any convenient manner as by the provision of back draft in portions of the back of the outer panel 10 into which the concrete 48 or other material may flow to bond the concrete 48 to the panel 10.

By casting the bonding concrete 48 into the frame 14 in the horizontal position it is not necessary to provide ties to secure the outer and the inner walls together because there is negligable hydrostatic pressure developed and the thermal characteristics of the wall is improved.

It will also be apparent that it is not necessary to provide a rigid framework such as the frame 14 because the cast section is limited to the thickness 18 of the frame 14 and therefore very little hydrostatic pressure build up will be encountered. As a result any convenient temporary mold or form may be employed to confine the concrete 48 or other cast material until it attains a set.

It will be understood that any of the features of my earlier filed application, Ser. No. 472,657 (W-2548) may be employed herein.

I claim:

1. The method of forming a composite wall for a building structure, said wall having a relatively thin outer shell formed of fiber reinforced concrete and having an outer surface defining the outside surface of the wall and adapted to be exposed to the atmosphere and having an inside surface, comprising the steps of positioning a preformed fiber reinforced shell horizontally with its outer surface in a face down position in contact with a substantially flat surface, securing a load bearing structure including a frame aligned with the inside surface of the fiber reinforced shell while the shell is in a horizontal position with the frame extending above the inside surface of the shell and having a substantially uniform thickness throughout and having an upper substantially flat surface, placing concrete in the space within the frame to increase the load bearing capacity of the load bearing frame, striking off the concrete in alignment with the upper surface of the frame after the concrete has attained an initial set and prior to its hardening, and thereafter elevating the wall to the vertical position thereby providing a composite wall having the fiber reinforced outer surface of the shell exposed to the atmosphere and the inner load bearing structure consisting of the frame and the concrete placed in the frame and extending parallel with and coextensive with the fiber reinforced shell.

2. The invention defined in claim 1 wherein sheet insulation is positioned in contact with the inside surface of the fiber reinforced outer shell, and the concrete is placed in the space within the frame in contact with the sheet insulation.

3. The invention defined in claim 1 wherein the frame is formed of metal and has bottom and top frame members adapted to extend horizontally when the wall is elevated to the vertical position, and a plurality of spaced metal studs having apertures in their mid-sections extend between and are secured to the bottom and top frame members, and the concrete is placed in the space within the frame while the wall is positioned horizontally.

4. The invention defined in claim 3 wherein sheet insulation is positioned in contact with the inside surface of the fiber reinforced outer shell, and the concrete is placed in the space within the frame in contact with the insulation while the wall is positioned horizontally.

* * * * *